United States Patent [19]

Furukawa et al.

[11] 4,143,719

[45] Mar. 13, 1979

[54] MULTI-VIBRO PILE HAMMER

[75] Inventors: Ken Furukawa, Zushi; Sadao Nunotani, Kanagawa, both of Japan

[73] Assignee: Kabushiki Kaisha Komatsu Seisakusho, Tokyo, Japan

[21] Appl. No.: 771,974

[22] Filed: Feb. 25, 1977

[30] Foreign Application Priority Data

| | | | |
|---|---|---|---|
| Dec. 3, 1976 | [JP] | Japan | 51-161429[U] |
| Dec. 3, 1976 | [JP] | Japan | 51-161430[U] |
| Feb. 27, 1976 | [JP] | Japan | 51-21822[U] |
| Aug. 30, 1976 | [JP] | Japan | 51-115021[U] |
| Aug. 30, 1976 | [JP] | Japan | 51-115022[U] |
| Dec. 28, 1976 | [JP] | Japan | 52-175326[U] |

[51] Int. Cl.[2] ..... E02D 7/18

[52] U.S. Cl. ..... 173/1; 173/49; 173/101

[58] Field of Search ..... 173/1, 49, 50, 51, 52, 173/101; 74/61; 175/55

[56] References Cited

U.S. PATENT DOCUMENTS

| | | | |
|---|---|---|---|
| 3,278,235 | 10/1966 | Bergstrom | 173/49 |
| 3,722,600 | 3/1973 | Hirata et al. | 173/52 |
| 3,828,864 | 8/1974 | Havenkamp et al. | 173/49 |
| 3,948,329 | 4/1976 | Cummings | 173/49 |

*Primary Examiner*—Robert A. Hafer

*Attorney, Agent, or Firm*—Armstrong, Nikaido, Marmelstein & Kubovcik

[57] ABSTRACT

A multi-vibro pile hammer comprising a plurality of vibro pile hammers having vibration generating units adapted to generate vibrations with different phases and in synchronism with one another, and the arrangement is made such that vibrations to be transmitted through the ground between the piles or sheet piles held by the hammers so as to be driven underground or pulled out therefrom can be counteracted thereby reducing the vibration transmitting region remarkably.

14 Claims, 27 Drawing Figures

MULTI-VIBRO PILE HAMMER

BACKGROUND OF THE INVENTION

This invention relates to a vibro pile hammer, and more particularly to a multi-vibro pile hammer for generating vibrations with different or reversed phases.

The vibro pile hammer of the kind specified which has heretofore been used comprises a driving means, a vibration generating unit, a power transmission means for connecting and driving the two, and a clamping means adapted to clamp piles or sheet piles, and is suspended through spring means from a stand so that vibrations caused by the vibration generating units can be transmitted to the piles or sheet piles to be driven underground or pulled out therefrom thereby reducing the noise level.

However, since the above-mentioned conventional vibro pile hammers has employed a single set of hammer to carry out such work, a single vibration is transmitted to the ground thereby increasing the vibration transmitting region. Further, disclosed in Japanese Utility Model Laying Open Publication No. 147,403/1975 is an arrangement which comprises two sets of multi-vibro pile hammers installed in parallel relationship, which however can not reduce the underground vibration transmitting region because the two sets of vibro hammers generate vibrations with the same phase which are in synchronism.

Of late, vibrations of such a kind have been subjected to extremely severe controls by authorities concerned with increasing civil works in cities and the vibrations have been treated as a public hazard.

SUMMARY OF THE INVENTION

The present invention has been contemplated in view of the above-mentioned circumstances, and has for its object to provide a vibro pile hammer comprising a plurality of vibro pile hammers installed in parallel relationship and adapted to generate vibrations which can be taken out with different or reversed phases so that when the vibrations are transmitted to piles or sheet piles to drive them underground or pull out them therefrom the vibrations transmitted underground can be counteracted thereby reducing the vibration transmitting region and enabling such operations to be effected at a high efficiency.

The objects of the present invention will be summarized below for easier understanding of it.

(1) When driving underground or pulling out therefrom at least two sets of piles or sheet piles at the same time by means of at least two sets of vibro pile hammers, the adjoining vibro pile hammers generate vibrations with different or reversed phases so that the vibrations to be transmitted from the piles or sheet piles to the ground can be counteracted thereby promoting the damping of vibrations transmitting region remarkably.

(2) To improve operational efficiency by driving underground or pulling out therefrom a plurality of piles or sheet piles at the same time.

(3) To interconnect the vibration generating units of a plurality of vibro pile hammers installed in parallel relationship so that they can be driven synchronously to generate vibrations with different or reversed phases.

(4) To reduce the weight of the multi-vibro pile hammer device and achieve easier maintenance and inspection thereof by making the arrangement such that the plurality of vibro pile hammers installed in parallel relationship are driven by one or a plurality of driving means less than that of the hammers.

(5) To interconnect stands for suspending the plurality of vibro pile hammers installed in parallel relationship by means of hinge means and universal joints etc, to permit oscillation or turning of the hammers both in vertical and horizontal planes so that they can follow or move in the direction of driving and pulling out of piles or sheet piles thereby preventing wear and tear of clamping means and generation of abnormal stresses.

(6) To enable the spacing between the vibro pile hammers installed in parallel relationship to be adjusted in response to the spacing between piles or sheet piles to be driven underground or pulled out therefrom.

(7) To permit movements of clamping means of the plurality of vibro pile hammers in a plane at right angles to the longitudinal axis of the hammers and enable their spacing to be automatically adjusted in response to the spacing between the piles or sheet piles to be driven underground or pulled out therefrom.

DESCRIPTION OF PREFERRED EMBODIMENTS

Figure 1:
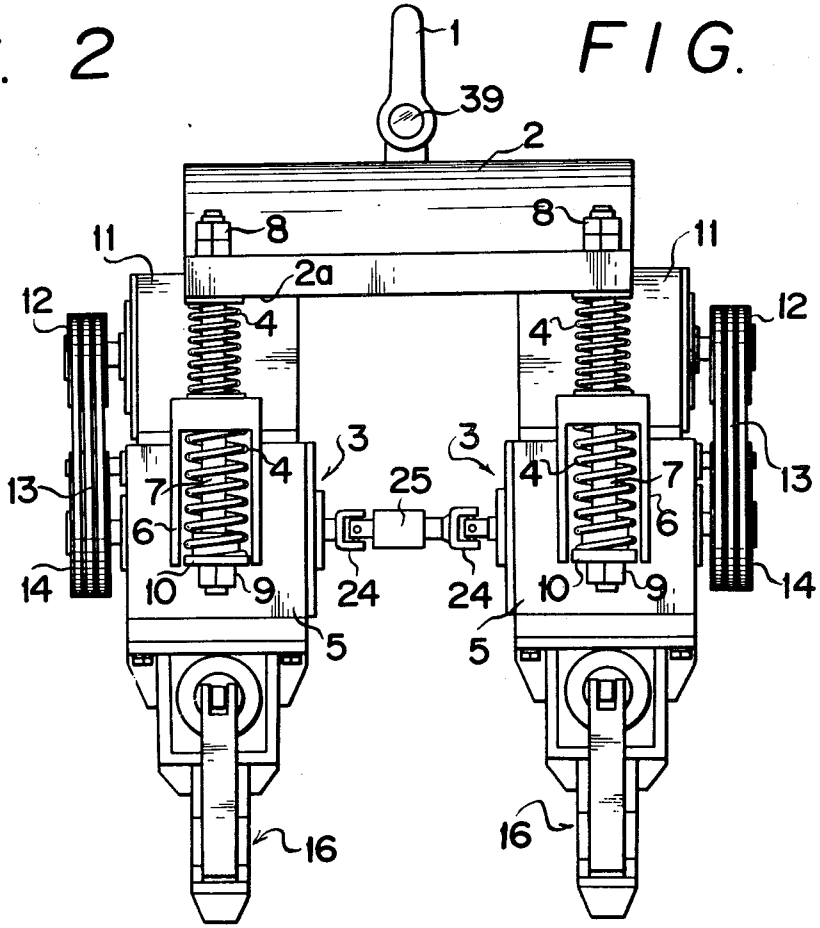
FIG. 1 is an overall front view of a multi-vibro pile hammer according to the present invention.
Figure 2:
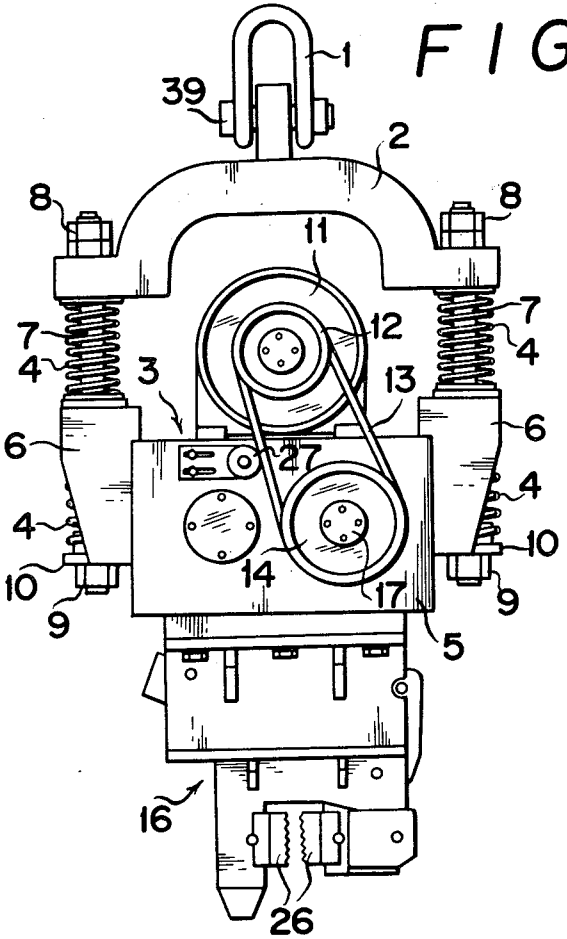
FIG. 2 is an elevational view of the left side of the same.

FIG. 1 shows the basic configuration of multi-vibro pile hammer which comprises a stand or frame 2 provided with hook means 1 and having a pair of vibration generating units 3, 3 suspended through spring means 4, 4.

Stated more specifically, inserted into a bracket 6 fixedly secured to a housing 5 is a rod 7, one end of which is rigidly secured to the stand 2 by means of nuts 8. A pair of spring means 4 extend resiliently between lower face 2*a* of the stand 2 and the upper face of the bracket 6 and also between the bracket 6 and a spring retainer 10 fixedly secured to the other end of the rod 7 by means of a screw or nut 9. The vibration generating units 3, 3 thus constructed are mounted or suspended from the stand 2.

Figure 3:
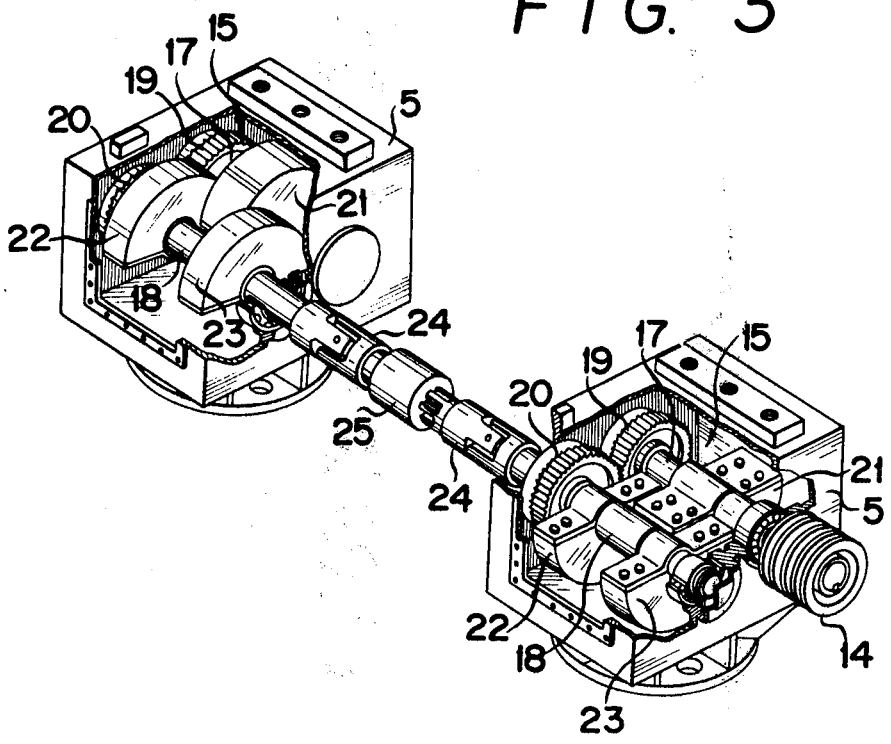
FIG. 3 is a partly broken perspective view of vibration generating means.

Each of the above-mentioned vibration generating units 3, 3 is driven by way of a driving means 11, a pulley 12, a V-belt 13 and a pulley 14, and comprises a vibration generating means 15 for generating only vertical vibration as shown in FIG. 3 and a clamping means 16 for suspending and carrying a pile.

Each of the above-mentioned vibration generating means 15, 15 comprises, as shown in FIG. 3, a driving shaft 17 and a driven shaft 18 installed in parallel therewith and which are mounted rotatably through bearings within the housing 5, synchronous gears 19, 20 meshing with each other for rotating said driving and driven shafts in opposite directions, said driving shaft 17 having a pulley 14 and a counterweight 21 fixedly secured thereto, said driven shaft 18 having fixedly secured thereto counterweights 22 and 23. Therefore, the arrangement is made such that when the driving shaft 17 is driven by the driving means by way of the pulley 14 the counterweight 21 and the counterweights 22 and 23 are rotated in the opposite directions so as to counteract the transverse vibrations and generate the vertical vibration only.

Further, the vibration generating means 15, 15 of the adjoining pair of vibration generating units 3, 3 have, as shown in FIG. 3, respective driven shafts 18 interconnected displaceably by way of universal joints 24, 24 and coupling means 25. The counterweights 21, 22 and 23 of the adjoining vibration generating means 15, 15 are relatively located so that when one of them is at a top dead centre the other occupies a bottom dead centre and vice versa, that is to say; both the vibration generating means can generate vibration with phase difference of 180 degrees.

Each of the aforementioned clamping means 16, 16 has a pair of claws 26, 26 which can be freely opened and closed. Reference numeral 27 denotes a tension roller adapted to apply a tension on the V belt 13 driven by the driving means 11.

The operation of the multi-vibro pile hammer according to the present invention will now be described in detail below.

In the first place, piles or sheet piles are suspended from or carried by the clamping means 16, 16 of the vibration generating units 3, 3. Then, the driving means 11, 11 of the vibration generating means 15, 15 are driven so that the driving shaft 17 can be rotated by way of the pulley 12, V belt 13 and the pulley 14, and at the same time the driven shaft 18 connected to the driving shaft 17 through the synchronous gears 19 and 20 is rotated in the opposite direction. Such an operation enables the horizontal or transverse vibrations to be counteracted and only the vertical vibration to be generated, and therefore the piles can be driven under ground.

Whilst, since the vibration generating units 3, 3 are interconnected so as to locate respective counterweights 21, 22 and 23 oppositely or reversely, the left and right side vibration generating means 15, 15 can produce vibrations with different or completely reversed phases so that the suspended and carried piles can be driven underground while they are vibrated with different or reversed phases. As a result, the vibrations to be transmitted through the ground can counteract, and therefore there is almost no occurence of ground vibration as a whole.

Figure 4:
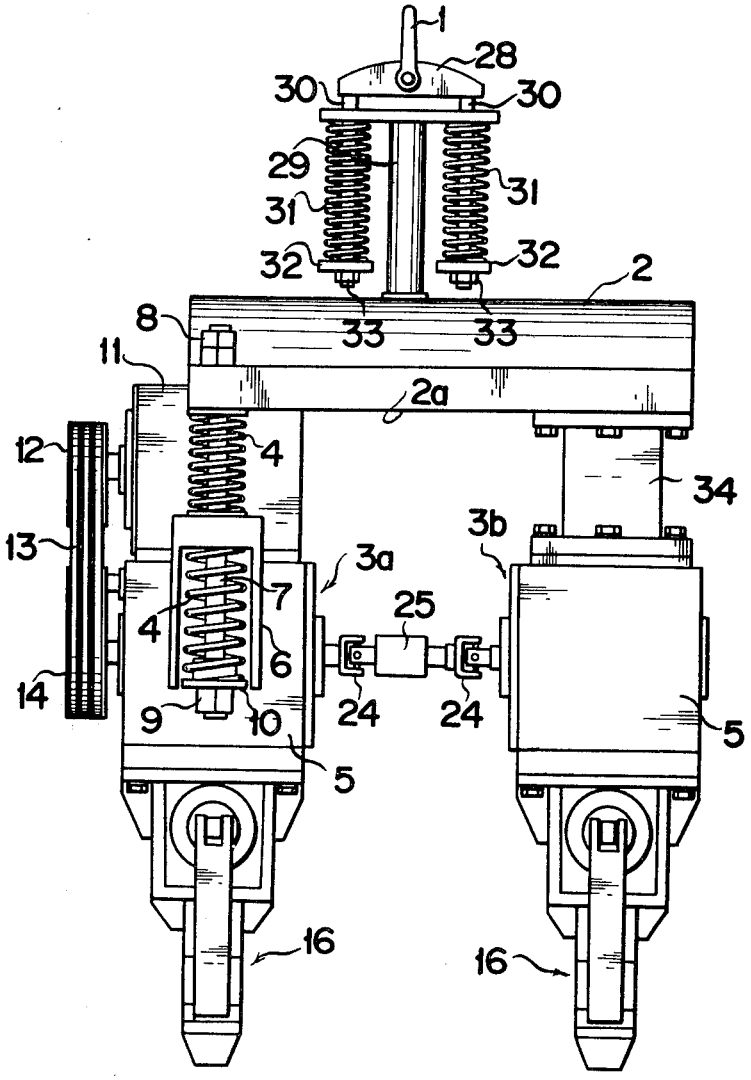
FIG. 4 is a plan view showing a further example of multi-vibro pile hammer provided with a single driving power source installed at one place for a plurality of vibro pile hammers.
Figure 5:
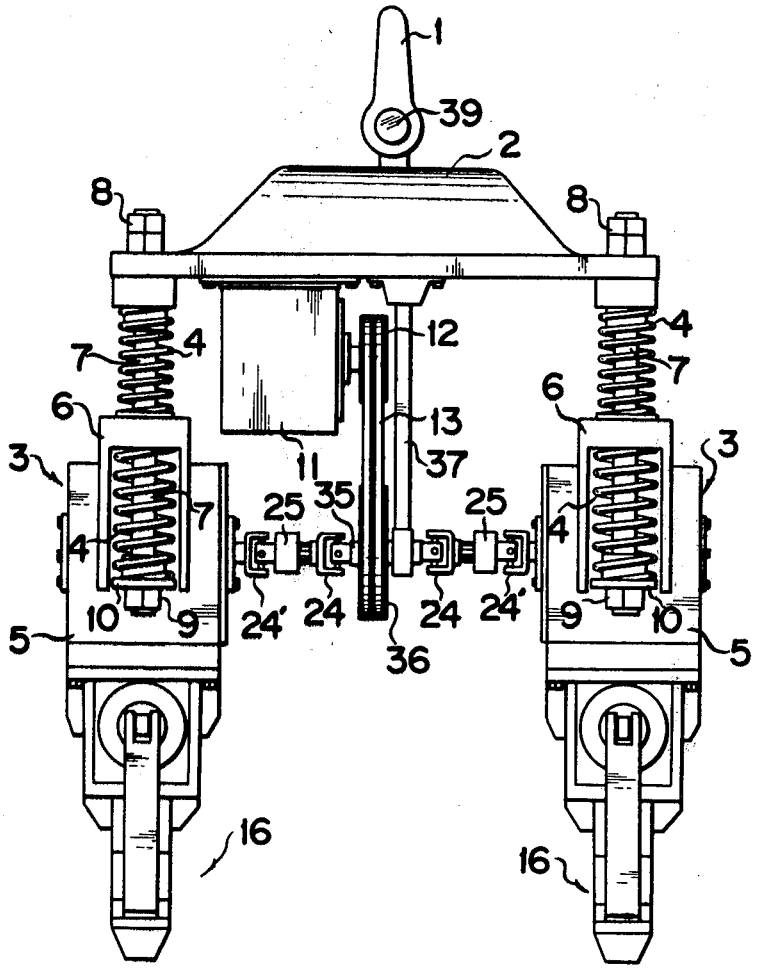
FIG. 5 is a plan view showing a still further example of multi-vibro pile hammer having a similar construction as that of FIG. 4.

FIGS. 4 and 5 illustrate examples wherein a single driving means 11 is provided for a plurality of vibration generating units 3*a* and 3*b*.

The multiple-vibro pile hammer of FIG. 4 comprises a suspension member 28 provided with a hook means 1, and a stand 2 suspended from the member 28 by way of springs 31. Stating in brief, rods or rod-shaped members 30, 30 suspended from the suspension member 28 are inserted into a bracket 29 fixedly secured to the stand or frame 2, and each of the springs 31 is permitted to extend as a shock absorber resiliently between the bracket 29 and a spring retainer 32 fixedly secured to the lower end of the rod 30 by means of a nut 33. The stand 2 can move up and down relative to the suspension member 28 thereby absorbing the shock load as and when occurred.

In this example, the vibration generating unit 3*a* on one side is suspended from the above-mentioned stand 2 in the similar manner as that of FIG. 1, whilst the vibration generating unit 3*b* on the other side is fixedly secured to the stand 2 through a bracket 34.

Further, the adjoining vibration generating units 3*a* and 3*b* are interconnected so that they can produce vertical vibrations with a phase difference of 180° relative to each other as shown in FIG. 3.

The multi-vibro pile hammer shown in FIG. 5 comprises a stand 2 provided with hook means 1, driving means 11 and a bracket 37, both said driving means and said bracket being fixedly secured to the stand 2. The driving means 11 has an output shaft which is secured to a pulley 12 so that the power developed thereby can be transmitted through a V belt 13 to a driven pulley 36.

The pulley 36 has a shaft 35 which is rotatably carried by the bracket 37, and both ends of which are connected through universal joints 24, 24, coupling means 25, 25 and universal joints 24', 24' to driven shafts 18, 18 of the adjoining vibration generating units 3a, 3b.

Figure 6:
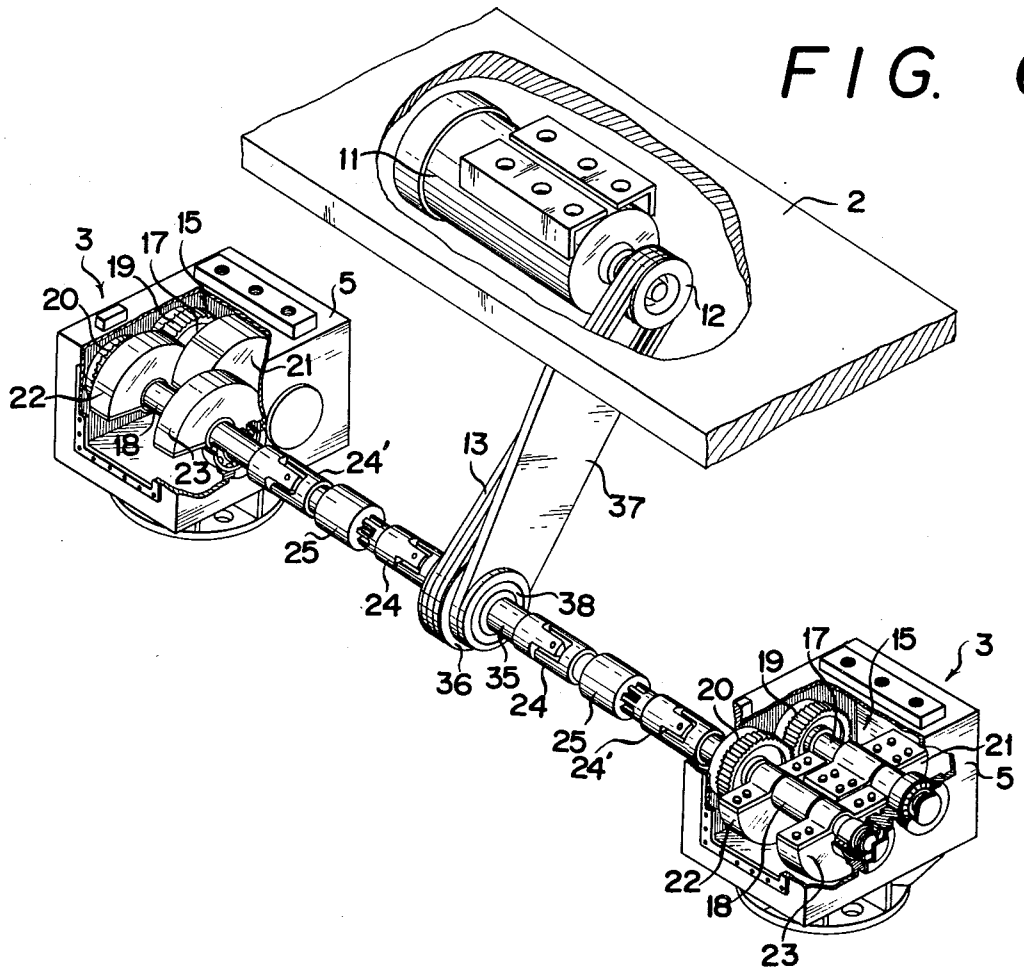
FIG. 6 is a partly broken perspective view of FIG. 5, FIGS. 7, 8 and 9 are explanatory views showing changes when piles or sheet piles are being driven underground.

Further, as shown in FIG. 6, the adjoining vibration generating units 3a, 3b are interconnected so that they can generate vertical vibrations with a phase difference of 180 degrees as in the case of the example shown in FIG. 3.

Figure 7:
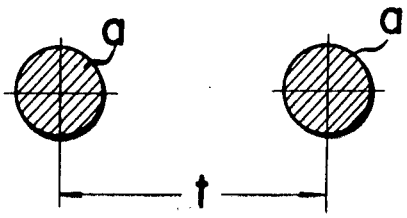
Figure 8:
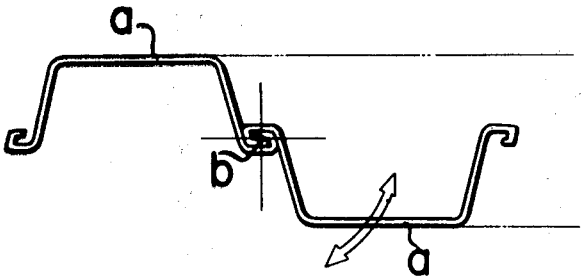
Figure 9:
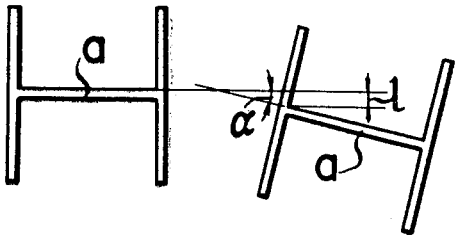

FIGS. 10, 12, 15 and 17 illustrate examples in which vibration generating units 3, 3 are suspended or mounted so as to be displaced relative to each other when piles or sheet piles move or turn relative to each other while they are being driven underground as shown in FIGS. 7, 8 and 9.

Figure 10:
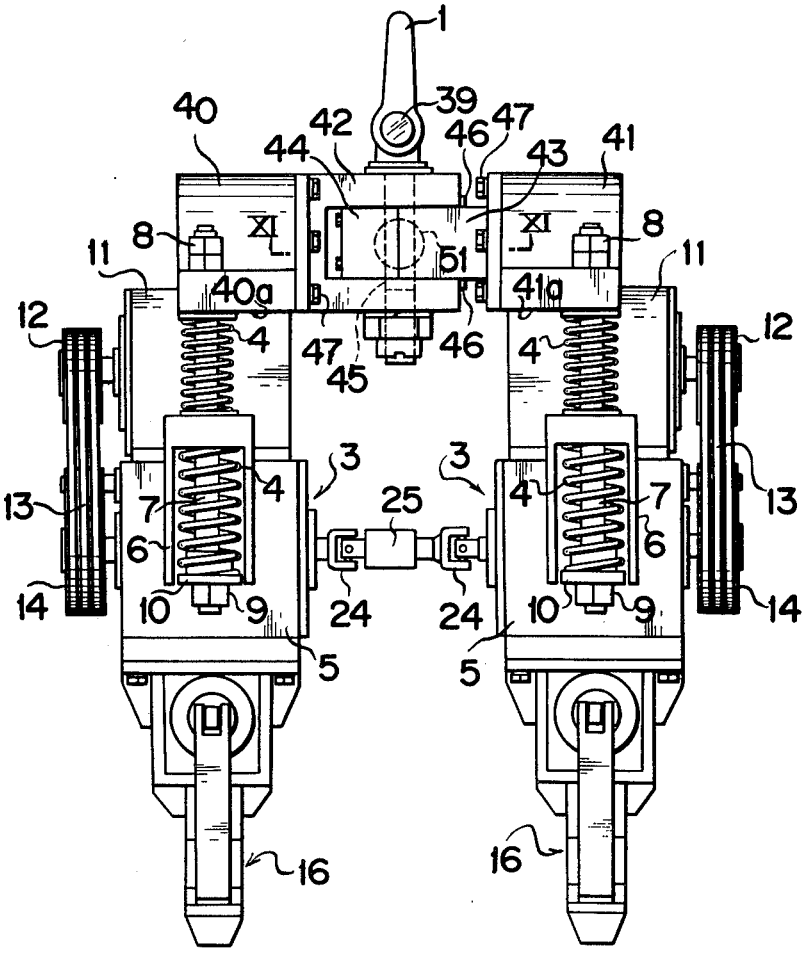
FIG. 10 is an overall front view of multi-vibro pile hammers mounted in such a manner that they can be displaced by rotating them relative to each other.

FIG. 10 shows a multi-vibro pile hammer comprising a first suspension member 40, a second suspension member 41, and vibration generating units 3, 3 suspended, respectively, from the suspension members through spring means 4, 4.

Figure 11:
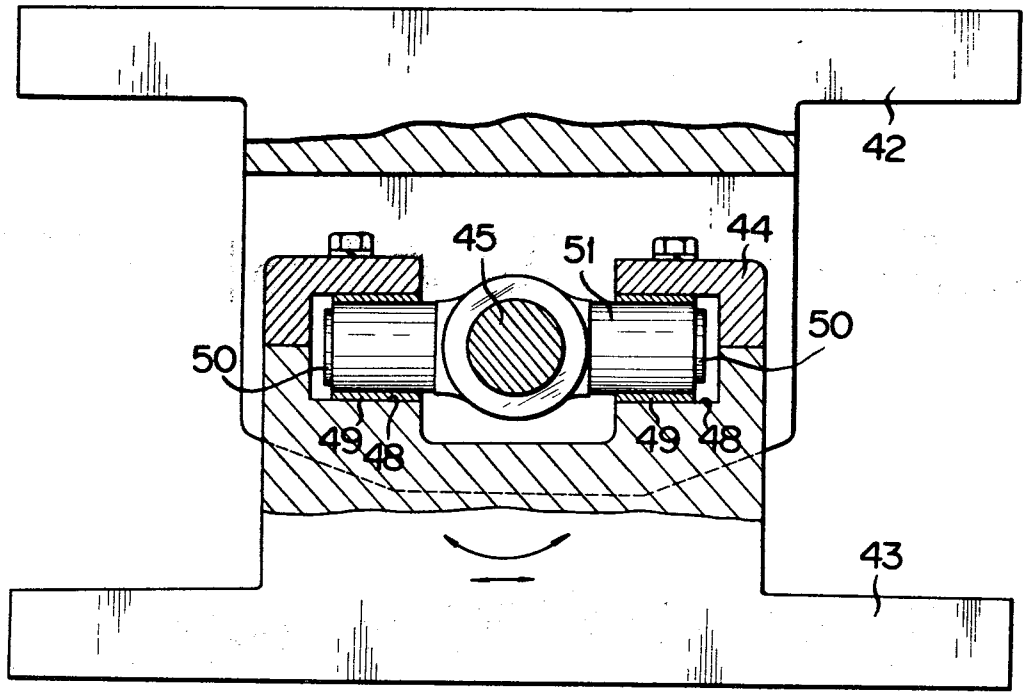
FIG. 11 is a sectional view taken along line XI—XI in FIG. 10.

Stating in more detail, fixedly secured by means of bolts 47 to the opposite end faces of the first and second suspension members 40 and 41, respectively, are a U-shaped first bracket 42 and a plate-shaped second bracket 43 adapted to be inserted into the bracket 42. Further, as shown in FIG. 11, the second bracket 43 has a trunnion 51 mounted slidably in the transverse direction through a cap 44, and the trunnion 51 carries a longitudinal pin 45 inserted through it and the first bracket 42 and the second bracket 43.

Further, a hook 1 is pivotally mounted on the central and upper face of the first bracket 42 by means of a pin 39.

Reference numeral 48 denotes a guide hole for permitting sliding movements of the trunnion therein, 49 a bush, and 46, 50 stoppers.

The above-mentioned arrangement permits the first bracket 42 and the second bracket 43 to be rotated or turned relative to each other in the horizontal plane, and the trunnion 51 permits sliding movement of the vibration generating units in the horizontal plane or in the transverse direction.

Figure 12:
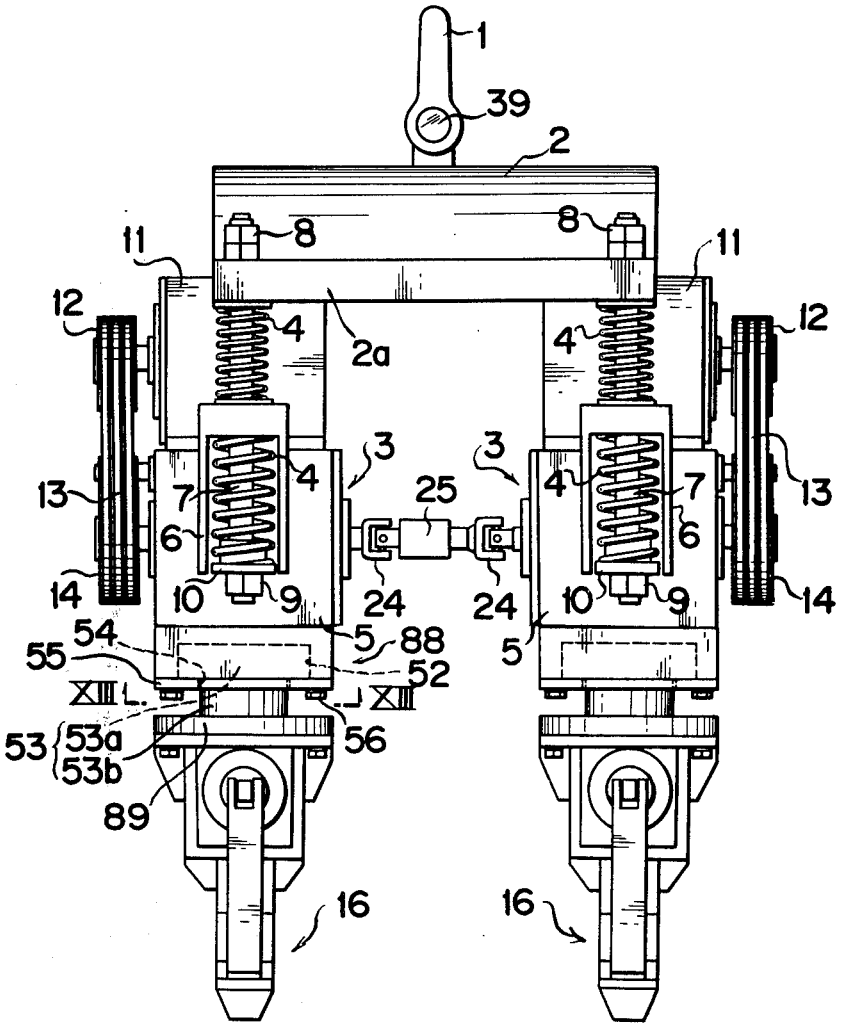
FIG. 12 is an overall front view of a multi-vibro pile hammer having a chuck mechanism which can be displaced by turning them relative to each other.
Figure 13:
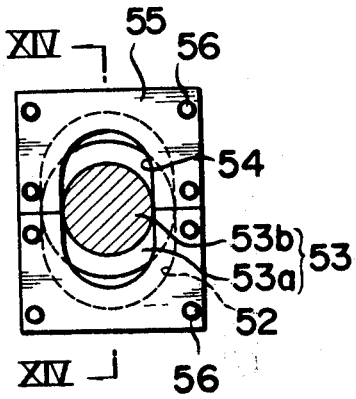
FIG. 13 is a sectional view taken along line XIII—XIII in FIG. 12.
Figure 14:
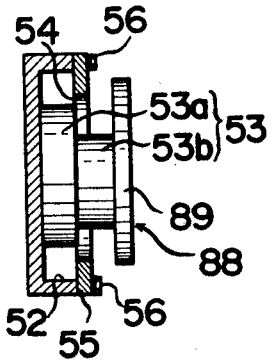
FIG. 14 is a sectional view taken along line XIV—XIV in FIG. 13.

FIG. 12 illustrates an example of multi-vibro pile hammer of the present invention having an engaging member 88 mounted between a vibration generating unit 3 and clamping means 16 so that the engaging member 88 can be suspended from and carried by the unit 3 to permit horizontal displacements or rotations of the clamping means 16 relative to the unit 3.

Stating specifically, each of the vibration generating units 3, 3 comprises a housing 5 having an engaging member 88 mounted thereunder and which has an elongated groove perforated therethrough. Inserted slidably or rotatably in the elongated groove 52 is an engaging member 53 which is fixedly secured through a flange 89 to clamping means 16 as an integral part thereof. The clamping means 16 is slidably and rotatably suspended from the vibration generating unit 3 through the flange 89 by fixedly securing a cover 55 to the lower part of the unit 3 by tightening up bolts 56, said cover 55 having an elongated or elliptical opening 54 formed therein and through which a shaft portion 53b of the flange 89 can be moved freely.

Figure 15:
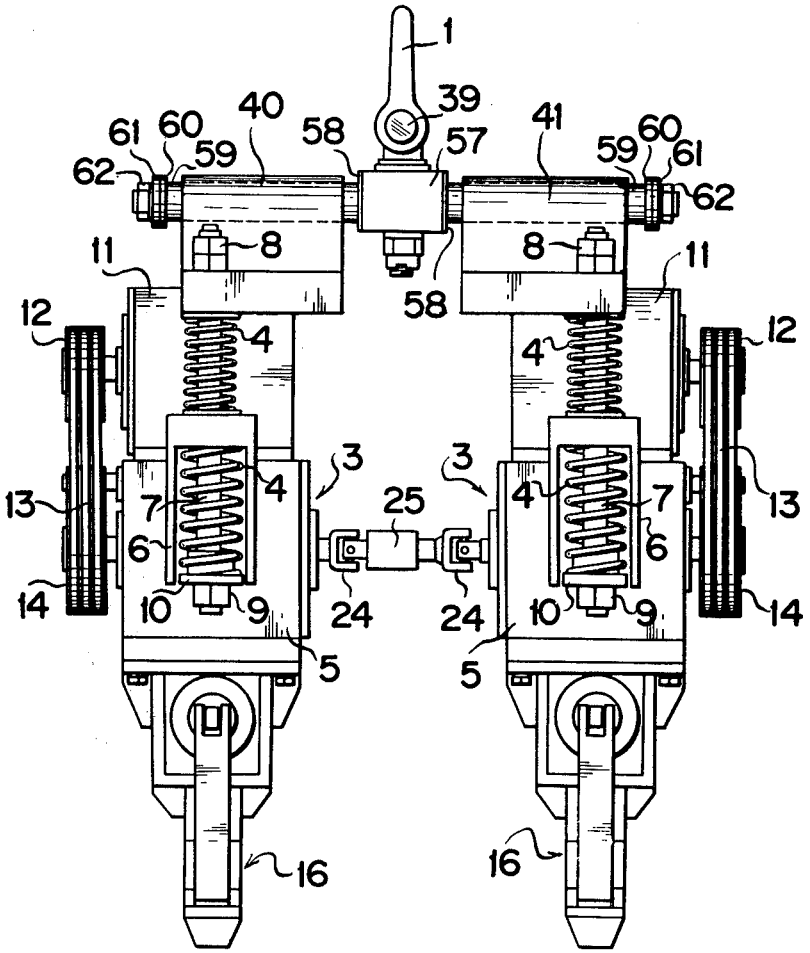
FIG. 15 is an overall front view of vibro pile hammers mounted in such a manner that they can be displaced transversely relative to each other.

FIG. 15 shows a further example of multi-vibro pile hammer which comprises a first suspension member 40, a second suspension member 41, and vibration generating units 3, 3 suspended from the suspension members through spring means 4, 4, respectively. In this example, the arrangement is made such that the first and second suspension members 40 and 41 are carried by a guide shaft 59 so as to permit the vibration generating means 3, 3 to come close or set apart relative to each other in the direction at right angles to the direction of vibration caused thereby.

Figure 16:
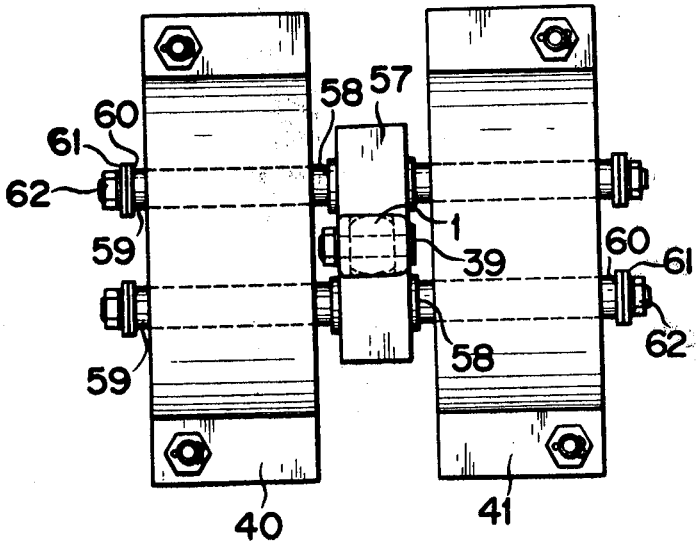
FIG. 16 is a plan view of the same.

Stating in brief, as shown in FIG. 16, a pair of guide shafts 59, 59 extend slidably in parallel relationship in the transverse direction through the first and second suspension members 40 and 41. Each of the guide shafts 59 has at both ends thereof a flange 61 fixedly secured thereto by tightening up a nut 62, and the flange 61 is provided with a stopper 60 made of an elastic material. The guide shafts 59 have at the intermediate portion thereof a bracket 57 inserted from the outside and fixedly secured thereto. A hook means 1 is pivotally mounted on the bracket 57 by means of a pin 39.

Figure 17:
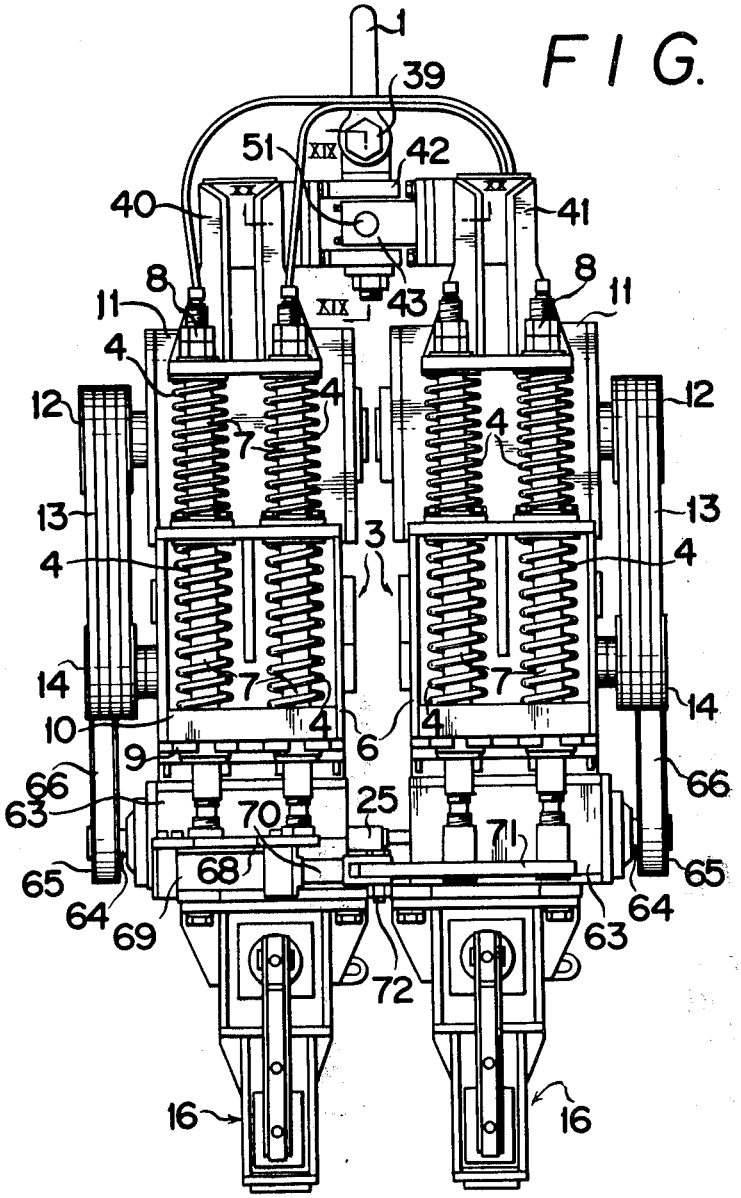
FIG. 17 is an overall front view of multi-vibro pile hammer mounted in such a manner that they can be displaced by turning them relative to each other.

FIG. 17 illustrates a further example of multi-vibro pile hammer which comprises a first suspension member 40 and a second suspension member 41 serving as stand or frame means, and vibration generating units 3, 3 suspended, respectively, from the members 40 and 41 through springs 4, 4, said vibration generating units being interconnected in such a manner that they can rotate or slide in the direction at right angles to the direction of vibration generated thereby.

Figure 18:
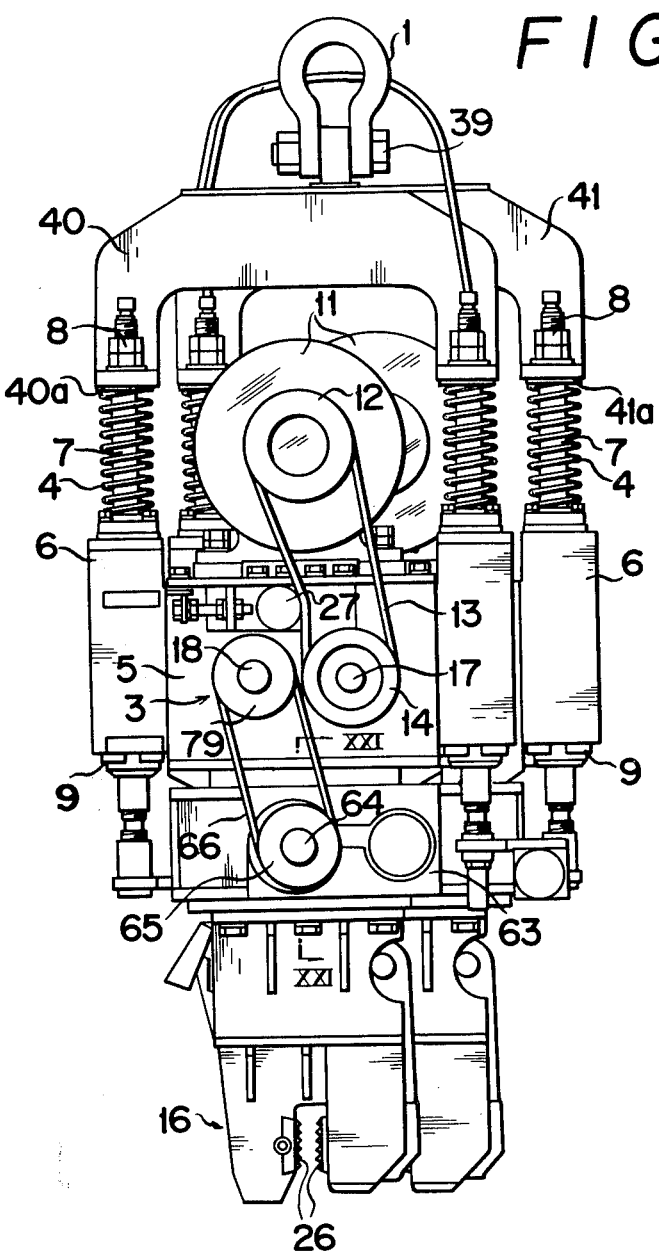
FIG. 18 is a left side elevational view of FIG. 17.
Figure 19:
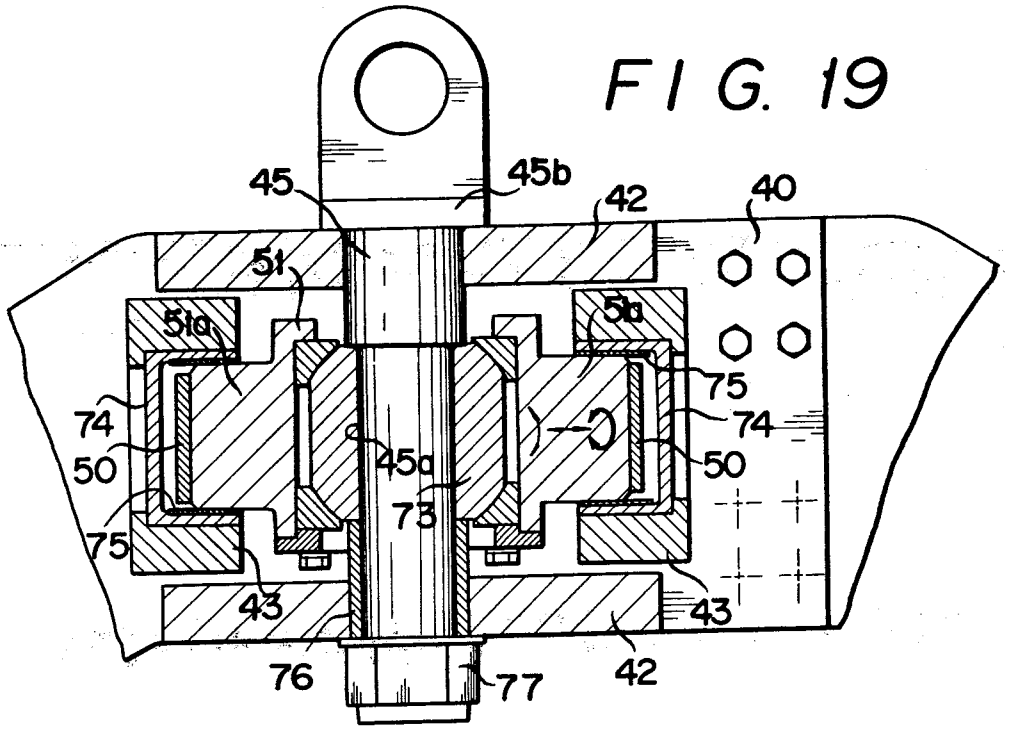
FIG. 19 is a sectional view taken along line XIV—XIV in FIG. 17.
Figure 20:
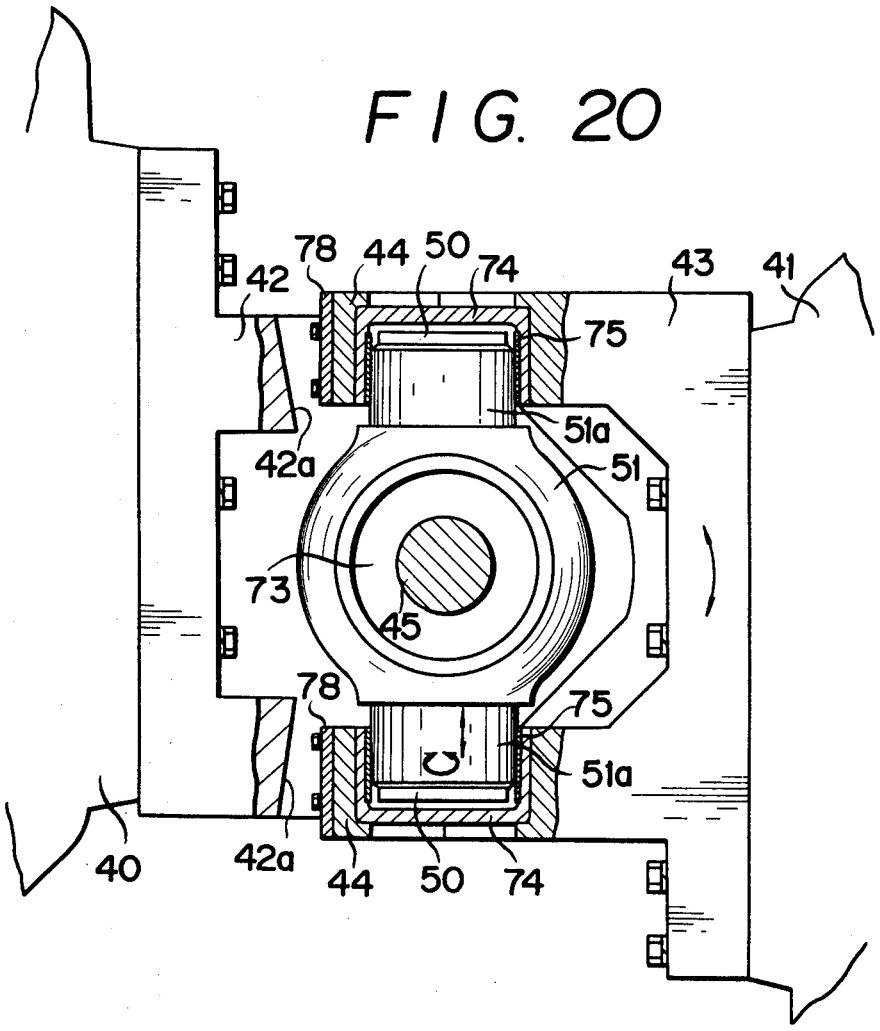
FIG. 20 is a sectional view taken along line XX—XX in FIG. 17.
Figure 21:
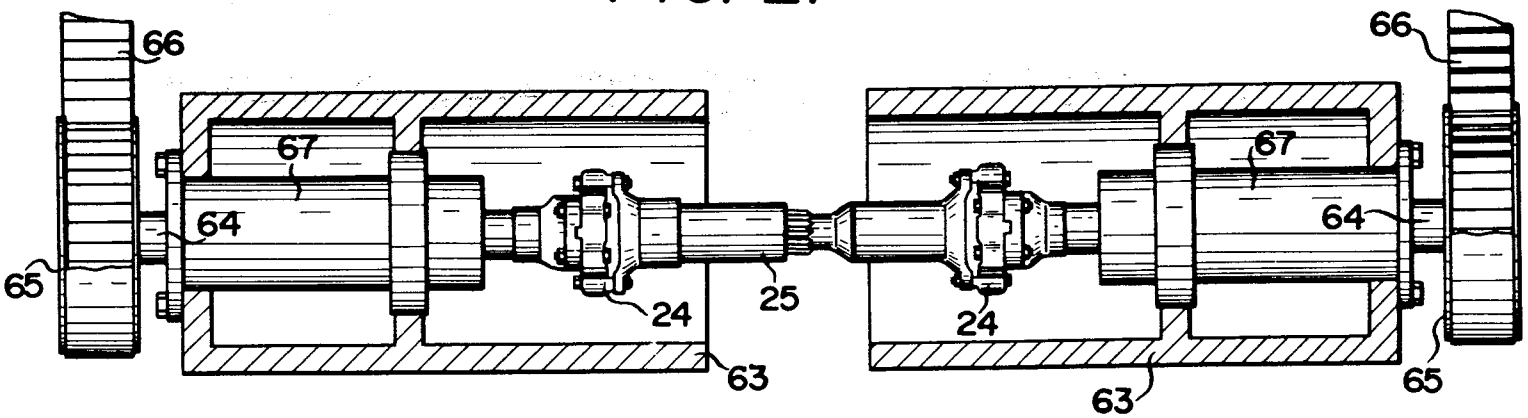
FIG. 21 is a sectional view taken along line XXI—XXI in FIG. 18.

Stated in brief, as shown in FIG. 18, the vibration generating units 3, 3 are suspended, respectively, from the first suspension member 40 and the second suspension member 41 through the springs 4, 4. Inserted through a bracket 6 fixedly secured to a housing 5 are rods 7, one end of each of which is fixedly secured to the suspension member using nuts 8, and a pair of springs 4 extend resiliently between the lower faces 40a, 41a of the suspension members 40, 41 and the bracket 6, and also between the bracket 6 and a spring retainer 10 fixedly secured to the other end of each rod 7 by means of a screw 9 so that the vibration generating units 3, 3 can be resiliently mounted on the first and second suspension members 40 and 41.

Fixedly secured to the upper part of each of the above-mentioned housings 5 is a driving means 11, the rotation of which can be transmitted through a pulley 12 and a V belt 13 to a pulley 14.

Further, as mentioned above, the vibration generating units 3, 3 have respective counterweights adapted to be rotated in opposite directions so as to counteract the transverse vibration and permit generation of vertical vibration only.

Fixedly secured to the respective lower faces of the housings 5 are housings 63, each of which includes a shaft 64 rotatably carried in bearings 67. The shafts 64 are interconnected by means of universal joints 24, 24 and a coupling means 25. Each of the shafts 64 is driven by the power transmitted through a driven pulley 65, a timing belt 65 and the pulley 14. A pair of adjacent counterweights are interconnected so that when one of them is at a top dead centre the other occupies a bottom dead centre and vice versa, that is to say; they can generate vibrations with phase difference of 180° or reversed phases. For this reason, the vertical generating units 3, 3 can generate vibrations with different or reversed phases.

Further, each of the housings 63 has a clamping mechanism 16 which is suspended therefrom and fixedly secured thereto and which includes a pair of claws capable of being opened and closed freely.

Fixedly secured to the opposite end faces of the above-mentioned first and second suspension members 40 and 41 are flat plate-shaped york members 42 and U-shaped york members 43 adapted to be fitted into the york members 42.

The york members 43 are bifurcated horizontally and carry rotatably and slidably therein both end shaft portions 51a, 51a of a trunnion 51 through caps 44, cylindrical retainers 74 and bushes 75. In the central portion of the trunnion 51 there extends a longitudinal pin 45 which is adapted to be inserted into the york members 42 and 43 and which includes a central shaft portion **45*a* pivotally carried by a spherical joint 73. The lower part of the longitudinal pin 45 is allowed to pass through collar 76 of one of the york members 42 and is secured thereto by tightening up a nut 77 so that flange portion 45*b* can abut against the other one of the york members 42, and the york members 42 and 43** can be rotated in the horizontal plane and slidden horizontally relative to each other.

Further, hook means 1 is pivotally mounted on the upper part of the longitudinal pin 45 by means of a pin 39.

Reference numeral 50 represents a stopper for preventing turning of the trunnion 51, and 78 a stopper fixedly secured to a cap 44 opposite to the end face **42*a* of the york member 42** for preventing turning thereof.

Figure 22:
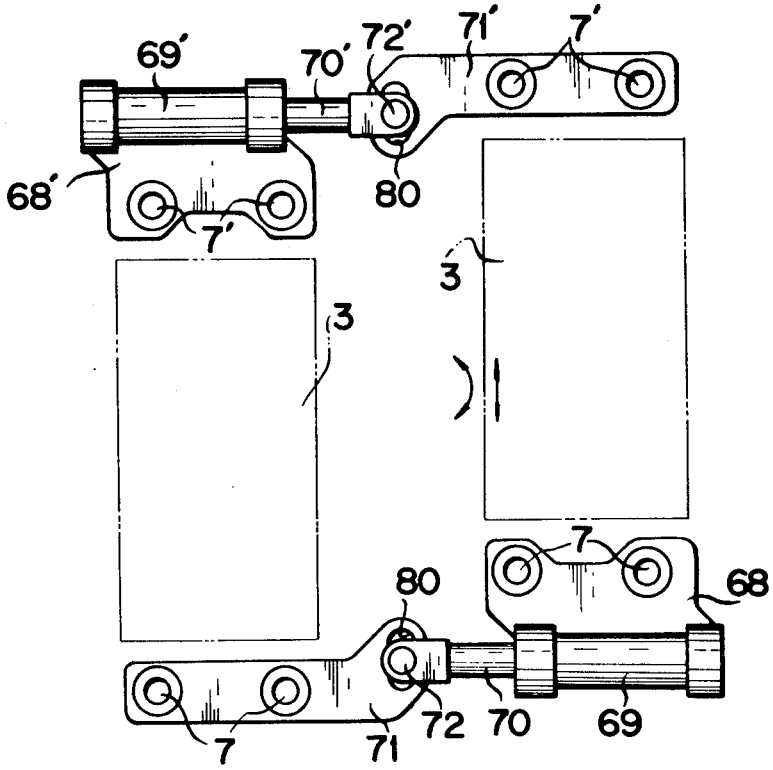
FIG. 22 shows the lower part of FIG. 17.

As can be seen from FIG. 22, a hydraulic cylinder 69 is fixedly secured through a plate 68 to the lower ends of the rods 7 on one side of one of the above-mentioned vibration generating unit 3. The hydraulic cylinder includes a movable rod 70 having a pin 72 fitted to the leading end thereof which is loosely fitted in an elongated groove 80 formed in a plate 71 fixedly secured to the lower ends of the rods 7 on one side of the other vibration generating unit 3. Further, another hydraulic cylinder 69' fixedly secured through a plate 68' to the lower ends of the rods 7' on the other side of the above-mentioned other vibration generating unit 3. The hydraulic cylinder 69' includes a movable rod 70' provided with a pin 72' which is loosely fitted into an elongated groove 80' formed in a plate 71' fixedly secured to the lower ends of the rods 7' on the other side of the other vibration generating unit 3.

Figure 23:
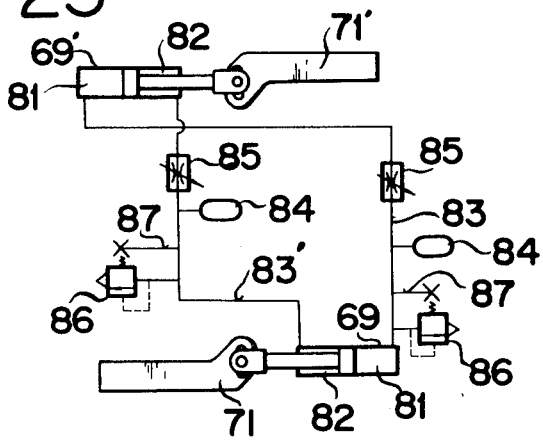
FIG. 23 shows hydraulic fluid circuits for hydraulic cylinders shown in FIG. 22.

Referring to FIG. 23, chambers 81 defined on the cylinder's closed ends of the hydraulic cylinders 69 and 69' are permitted to communicate with each other by way of a pipe 83, whilst chambers 82 defined on the rod ends of pistons are permitted to communicate with each other through a pipe 83'. Each of the pipes 83 and 83' includes an accumulator 84, a variable flow regulating valve 85, a relief valve 86 and a discharge port 87.

In operation, in the first place, piles are suspended from and carried by the clamping arrangements of the pair of vibration generating units 3, 3. And then, the driving means 11, 11 of the vibration generating means 3, 3 are driven so that the driving shaft 17 can be driven through the pulley 12, the V belt 13 and the pulley 14; and at the same time the driven shaft 18 can be rotated in the opposite direction in synchronism therewith by the action of the synchronous gears thereby counteracting horizontal components of the vibration generated thereby and rendering effective only the vertical component thereof. Therefore, the piles can be driven underground. Since the counterweights of the pair of vibration generating units 3, 3 are interconnected reversely or oppositely to each other, the vibration generating units 3, 3 will generate vibrations with different or reversed phases in synchronism with each other so that the pair of piles can be vibrated alternately. In this case, the spacing between the pair of piles is so small as compared with the wavelength of the vibration to be transmitted through the ground that the vibration generated by driving the piles can hardly be transmitted to the ground a short distance apart from the piles. (In general, the wavelength of ground vibration of 20 to 30 Hz is more than 10 meters.)

Further, the first and second suspension members 40 and 41 can be rotated relatively through the york members 42, 43 and the longitudinal pin 45, and therefore, the pair of vibration generating units 3, 3 can be rotated relative to each other in the direction at right angles to the direction of vibration generated thereby.

Further, the trunnion 51 which carries pivotally the longitudinal pin 45 can be slidably moved in the horizontal direction so that the pair of vibration generating units 3, 3 can be slidably displaced relative to each other in a plane at right angles to the direction of vibration generated thereby.

For this reason, even if the spacing between the pair of piles to be driven underground changed to some extent, the pair of clamping means can hold the piles securely thereby enabling the piles to be driven underground.

Further, there are mounted hydraulic cylinders 69, 69' and plates 71, 71' for the pair of vibration generating units 3, 3, and the movable rod 70 of the hydraulic cylinder 69 is connected to the plate 71 by means of the elongated groove 80 and the pin 72, and therefore the relative displacements of the pair of vibration generating units 3, 3 due to rotation and sliding movements thereof can be absorbed through the pin 72 and the elongated groove 80. Further, the resistance to sliding movements of the movable rod 70 within the hydraulic cylinder 69 can control or restrain relative displacements of the pair of vibration generating units 3, 3 due to rotation and sliding movements to some degree.

Further, the driven shafts 18 of the pair of vibration generating units 3, 3 are interconnected in such a manner that the pair of shafts 64, 64 mounted within the housings 63 can be interconnected by way of the universal joints 24 and the coupling means 25. Therefore, even if the spacing between the pair of vibration generating units 3, 3 is short, a sufficiently long distance can be obtained between the universal joints 24, 24, and so, the arrangement can be rendered operative in response to displacements of the pair of vibration generating units 3, 3.

Figure 24:
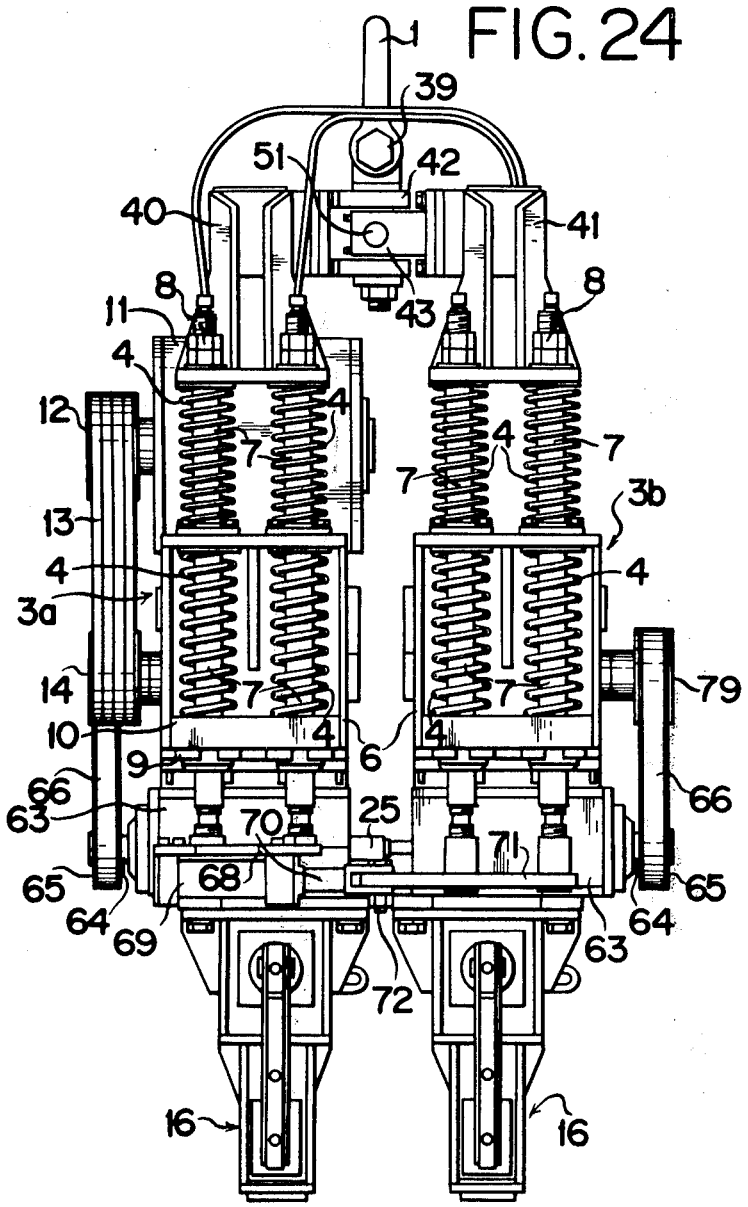
FIG. 24 is a front view showing a further example of multi-vibro pile hammer of FIG. 17 having a single driving means installed at one place for a plurality of vibration generating units.
Figure 25:
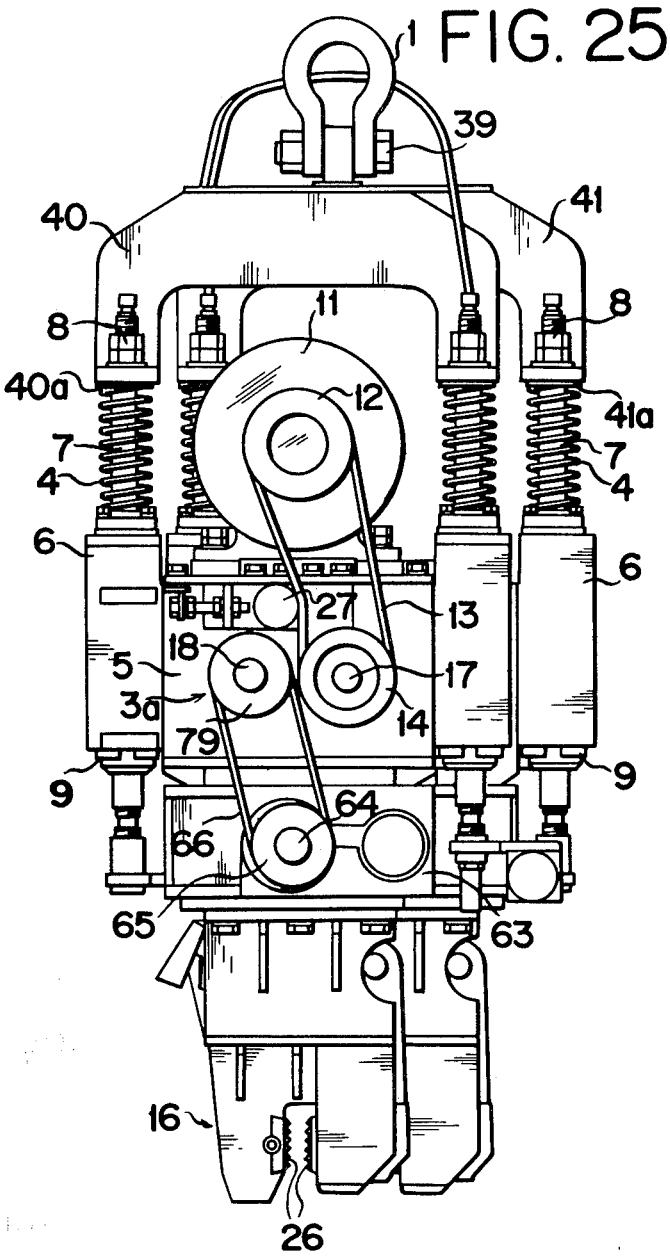
FIG. 25 is a side elevational view of the right side of the example of FIG. 24.

Further, according to the present invention, the same effect can be obtained by making an arrangement such that as shown in FIG. 24. Any one of the plurality of vibro pile hammers mounted in parallel relationship is provided with driving means 11 for operating the vibration generating units **3*a* and 3*b***.

In operation, when the driving means 11 is actuated, a driving shaft 17 of the vibration generating unit **3*a* is driven through a pulley 12, a V belt 13 and a pulley 14 thereby generating vibration. At the same time, a driven shaft 18 of another vibration generating unit 3*b* is rotated by way of its pulley 65, timing belt 66 and pulley 79 through a pulley 79, a timing belt 66, a driven pulley 65, a shaft 64, an universal joint 24 and coupling means 25 all of which are mounted on the driven shaft 18 of the vibration generating unit 3*a* thereby generating vibration. As mentioned above, both the vibration generating units 3*a* and 3*b* are driven by the single set of driving means or power source 11, and the counterweights of the vibration generating units are interconnected reversely in the vertical plane as in the case of previously mentioned embodiments so that the pair of vibration generating units 3***a* and 3*b* can synchronously generate vibrations with different or reversed phases.

Figure 26:
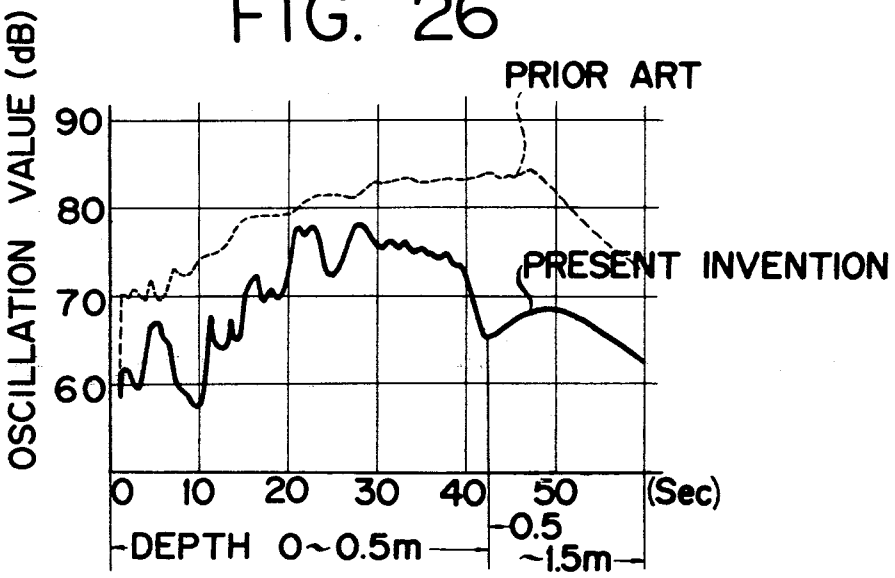
FIG. 26 shows an experimental result obtained when comparing the device of the present invention with the conventional one in which vibrations of the ground located about five meters apart from the sheet piles to be driven underground are platted.
Figure 27:
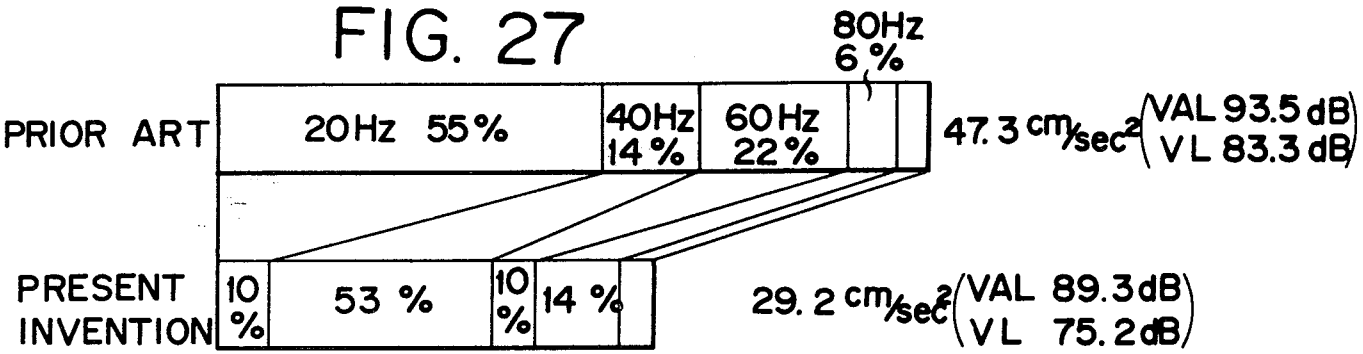
FIG. 27 shows ground oscillation frequency analysis results obtained by the use of the conventional vibro pile hammer and that of the present invention, respectively.

As is apparent from the experimental results shown in FIGS. 26 and 27, the multi-vibro pile hammer according to the present invention can reduce remarkably vibrations to be transmitted through the ground as compared with the conventional ones. The characteristic feature of vibration of the ground generated by the vibro pile hammer of the present invention resides in the fact that the component (20 Hz) of the forced oscillation generated by the vibration generating units can be entirely counteracted and converted into a component having 20 Hz $\times$ 2 = 40 Hz as its basic oscillation frequency.

As described hereinabove, when the multi-vibro pile hammer of the present invention is employed, piles can be driven underground efficiently and without generating vibrations with high level in the ground near the pile driving site, and also the arrangement is made such that a plurality of vibration generating units can be displaced relatively, so that piles can be driven underground successfully even if the piles were displaced during the driving work.

Moreover, the same effect can be obtained when the multivibro pile hammer of the present invention is used for the purpose of pulling out driven piles.

It is to be understood that the foregoing description is merely illustrative of the preferred embodiments of the present invention and that the scope of the invention is not to be limited thereto, but is to be determined by the scope of the appended claims.

What is claimed is:

1. A method of driving piles into the ground using vibro pile hammers said method comprising:

(a) positioning a plurality of vibro pile hammers in parallel to one another each having a vibration generating means; parallel to one another each having a vibration generating means;

(b) interconnecting and synchronizing the vibration generating means on adjacent vibro pile hammers;

(c) generating vertical vibrations in each of said vibro pile hammers which are of an opposite phase to the vertical vibrations of an adjacent vibro pile hammer whereby said piles are driven into the ground and the vertical vibrations transmitted through the ground between adjacent piles is substantially eliminated.

2. A multi-vibro pile hammer comprising:

(a) a plurality of vibro pile hammers installed in parallel to one another, each said vibro pile hammer comprising driving means, vibration generating means including means to elminate lateral vibrations, power transmission means for connecting and driving said driving means and said vibration generating means, clamping means attached to said vibration generating means and spring means for suspending said vibro pile hammer, wherein each vibration generating means generates vertical vibrations having a phase opposite to that of the adjacent vibration generating means;

(b) stand or frame means for suspending said plurality of vibro pile hammers parallel to one another, and;

(c) coupling means for interconnecting and synchronizing the vibration generating means of the plurality of vibro pile hammers such that the adjacent vibration generating means generate the vibrations of opposite phase, the opposite phase vibrations reacting with each other to thereby eliminate the vertical vibrations transmitted through the ground between the piles.

3. A multi-vibro pile hammer as claimed in claim 2, wherein each said vibration generating means comprises a housing, a driving shaft and a driven shaft which extend transversely within the housing, said driving and driven shafts being adapted to be rotated in opposite directions through at least a pair of gears, and eccentric weights of a substantially equal mass fixedly secured to said driving shaft and said drivers, respectively.

4. A multi-vibro pile hammer as claimed in claim 2, wherein the plurality of vibro pile hammers suspended in the parallel relationship include a space between the vibration generating means and the clamping means, and a shaft rotatably mounted within the housing and extending transversely in parallel with the vibro pile hammers, said shaft having at one end thereof a driven pulley adapted to receive the power in synchronism with or in response to the rotation of said vibration generating means, and having at the other end thereof coupling means for connecting the shaft ends of the adjacent vibro pile hammers so that the phases of vibrations generated by the vibro pile hammers are opposite to one another thereby reducing the spacing between the adjoining vibro pile hammers.

5. A multi-vibro pile hammer as claimed in claim 2, wherein said stand or frame means are interconnected by a hinge at the intermediate portion thereof, and hook means are formed on the upper end of the hinge, each of the members for forming said hinge being adapted to suspend a vibro pile hammer.

6. A multi-vibro pile hammer as claimed in claim 5, wherein said multi-vibro pile hammers suspended from the stand or frame means coupled by the hinge are interconnected such that they oscillate or rotate about the same axis as the hinge shaft.

7. A multi-vibro pile hammer as claimed in claim 2, wherein said stand or frame means comprises a bracket having a central longitudinally extending hole and two transverse holes extending at right angles to the central hole, a pair of guide shafts inserted into said transverse holes, and a pair of members slidably and rotatably attached to said pair of guide shafts, said longitudinal hole having hook means notatably fitted therein, each of said members having a vibro pile hammer suspended therefrom.

8. A multi-vibro pile hammer as claimed in claim 2, wherein said stand or frame means, comprises a spherical joint having a vertical hole formed therethrough, and a trunnion mounted rotatably on the spherical surface of said spherical joint, said trunnion being inserted and held in a yoke member of the second suspension member so that the trunnion can be moved in a direction at right angles to the direction of vibrations generated by the vibro pile hammers, said yoke member of the second suspension member, on which the trunnion is mounted, being adapted to be inserted between yoke members of the first suspension member wherein a longitudinal pin is rotatably inserted into said vertical hole of said spherical joint and fixedly secured to the yoke members of the first suspension member.

9. A multi-vibro pile hammer as claimed in claim 2, including at least one set of hydraulic cylinder and linkage means coupled to the upper portion of said clamping means for controlling the spacing between the clamping means of the plurality of parallel vibro pile hammers.

10. A multi-vibro pile hammer as claimed in claim 2, wherein the vibro pile hammers are attached to the stand or frame means with a space between adjacent vibro pile hammers in the direction at right angles to the direction of suspension of the vibro pile hammers.

11. A multi-vibro pile hammer as claimed in claim 2, wherein the coupling means for connecting said vibration generating means comprises universal joint means for connecting the ends of the driven shafts of adjacent vibration generating means, wherein the interconnection of said universal joint means is an axially slidable spline connection.

12. A multi-vibro pile hammer as claimed in claim 2, wherein displacing means are interposed between the vibration generating means and the clamping means of the vibro pile hammers said displacing means comprising a block having an elongated elliptical groove formed therein, an engaging member adapted to slide and engage with the elongated groove and a cover, said engaging member having at one end thereof an engaging portion slidably engageable with said elongated groove and held by the cover, and also having at the other end thereof a flange portion on which said clamping means is mounted such that the clamping means can be selectively displaced in the direction of suspension of the vibro pile hammers or in the direction at right angles thereto.

13. A multi-vibro pile hammer comprising a plurality of vibro pile hammers, stand or frame means, and hook means coupled to stand or frame means wherein each of the plurality of vibro pile hammers is suspended through spring means coupled to the stand or frame means, and wherein each of said vibro pile hammers comprises vibration generating means, including means for eliminating lateral vibrations, for generating vertical vibrations having a phase which is opposite to the phase of vibration of the adjacent vibration generating means and clamping means, a bracket fixedly secured to the central lower face of stand or frame means, said bracket having at the lower end thereof bearing means, a plurality of shafts and a driven pulley fitted to the shafts said driven pulley being adapted to be driven by driving means fixedly secured to the central lower face of said stand or frame means between said bracket and one of the vibro pile hammers so as to permit rotation of said shafts, wherein the ends of said shafts are connected to the vibration generating means of the vibro pile hammers such that the single driving means operates the vibro pile hammers.

14. A multi-vibro pile hammer comprising a first vibro pile hammer comprising a stand or frame means and vertically extending hook means coupled to said stand or frame means through first spring means, said stand or frame means having on one side thereof a first vibro pile hammer suspended therefrom through second spring means, said first vibro pile hammer suspended therefrom through second spring means, said first vibro pile hammer comprising driving means, first vertical vibration generating means including means for eliminating lateral vibrations, clamping means and power transmission means connected to the driving means for driving the first vibration generating means, said stand or frame means having on the other side thereof a second vibro pile hammer fixedly secured thereto which comprises second vertical vibration generating means including means for eliminating lateral vibrations and clamping means, the first and second vibration generating means being interlockingly connected by means for synchronizing the vertical vibrations such that the vertical vibrations of said first vibration generating means are of opposite phase to the vertical vibrations of the second vibration generating means and wherein the vibrations of both said first and second vibration generating means are transmitted through said first and second spring means to the piles to be driven underground.

* * * * *